United States Patent [19]

Edwards, Jr.

[11] Patent Number: 4,765,093

[45] Date of Patent: Aug. 23, 1988

[54] OVERHEAD TILT DOOR

[76] Inventor: Charles P. Edwards, Jr., 16728 E. 80th St. North, Owasso, Okla. 74055

[21] Appl. No.: 23,730

[22] Filed: Mar. 9, 1987

[51] Int. Cl.[4] ..... E05D 15/38

[52] U.S. Cl. ..... 49/197; 49/199

[58] Field of Search ..... 49/197, 198, 199, 200

[56] References Cited

U.S. PATENT DOCUMENTS

| | | | |
|---|---|---|---|
| 663,989 | 12/1900 | Wilson | 49/197 |
| 1,476,097 | 12/1923 | Nishkian | 49/197 |
| 1,998,416 | 4/1935 | Craine | 49/199 X |
| 2,054,191 | 9/1936 | Byrne | 49/197 |
| 2,054,735 | 9/1936 | Asquith | 49/197 |
| 2,141,515 | 12/1938 | Casse | 49/197 |
| 2,277,932 | 3/1942 | Mowers et al. | 49/199 |
| 2,323,585 | 7/1943 | Deuring | 49/197 |
| 2,695,170 | 11/1954 | Bacque | 49/197 X |
| 3,265,118 | 8/1966 | Smith | 49/107 X |
| 3,568,365 | 3/1971 | Pemberton et al. | 49/197 |

FOREIGN PATENT DOCUMENTS

| | | | |
|---|---|---|---|
| 1009528 | 5/1957 | Fed. Rep. of Germany | 49/197 |

*Primary Examiner*—Philip C. Kannan

*Attorney, Agent, or Firm*—Head & Johnson

[57] ABSTRACT

An overhead tilt door assembly for use with a wide range in size of framed openings from small garage doors to very large aircraft hangar doors. The door is a one-piece unit. The door is suspended on cables which distribute its weight over the top of the framed door opening. There are only four rollers used in the system. Two are mounted halfway up the door, one on each end and are mounted in vertical tracks. There are two other rollers mounted one on each end of the door near the top which are installed in very short vertical tracks attached to short radius ninety degree curved tracks that are fastened to horizontal tracks. Locking pins are provided at the bottom of the door and when the door is closed, the pins engage holes in the floor of the doorway to give added stability. No counterweights or springs are necessary, although counterweights may be helpful in some applications.

5 Claims, 6 Drawing Sheets

OVERHEAD TILT DOOR

BACKGROUND OF THE INVENTION

1. Field of Invention:

This invention relates to doors and particularly to one-piece type door and especially to an overhead tilt door.

2. Prior Disclosures:

Overhead doors used to close the doorway of structures ranging from one vehicle garages to airplane hangars have been in use for sometime. One such overhead door assembly construction is shown in U.S. Pat. No. 2,141,515. The door construction disclosed therein includes a system of vertical and horizontal tracks with the vertical tracks mounted adjacent the sides of the door frame and the horizontal tracks extending inwardly from the door frame. Rollers are provided at the upper ends of the door for engaging with the tracks. Another pair of rollers is mounted on the door below the center of mass thereof, but above the bottom of the door for engagement with the vertical tracks. The door is thus adapted to be swung outwardly and raised from a closed vertical position to a substantially horizontal overhead position. Counterweights act against the door below the center of mass at the points where the lower pair of rollers are mounted. Various other type overhead tilt doors are shown in U.S. Pat. Nos. 663,989; 1,476,097; 2,054,735 and 2,323,585.

SUMMARY OF THE INVENTION

This is a unique overhead tilt door assembly which has a support system and a guide system. The support system includes cables which distribute the door's weight over the top of the door frame opening. A power cable extends across the top of the doorway with one end extending above sheaves mounted over the doorway. Attached to this power cable are suspension lines which extend over the sheaves attached to the door frame. Each suspension line extends downwardly to a suspension line pin at about or just below the vertical midpoint of the door. The other end of the power cable is attached to a winch driven by a choice of electric, hydraulic or pneumatic motor.

The guide system includes two pair of rollers. The first pair are mounted about halfway up the door, one on each end thereof. These rollers are mounted in a vertical track supported by the frame of jamb of the doorway proper and are the pivot points about which the door tilts. There are two other rollers mounted, one on each end of the door near the top which are installed in very short vertical tracks which are attached to short radius ninety degree curved tracks that are secured to and open in horizontal tracks. The bottom of the door is provided with locking pins which, when the door is closed, extend into holes in the bottom of the doorway.

The door is operated by actuating the winch so as to pull the power cable and the individual suspension cables or lines mounted thereto so that the door is raised. The very short vertical tracks in which the two top rollers are mounted allow the door to rise a few inches vertically to disengage the locking pins on the bottom of the door and also locking brackets from pins mounted on the inside of the door header. As soon as the locking pins clear the floor, the top roller enters the curved track allowing the top of the door to begin tilting in and the bottom of the door to swing out. As the door continues up, the top rollers enter the horizontal tracks and when the door reaches its maximum height, the door will be in a horizontal position with the top half to the inside of the building and the remainder on the outside forming a porch or awning over the doorway. To close the door the process of opening the door is reversed. When the door is fully closed, it will be automatically locked in place by the pins in the bottom and the brackets at the top of the door.

It is thus an object of this invention to provide an overheat tilt door which uses no tension springs or counterweights. It is still a further object of this invention to provide a system whereby the weight of the door is distributed over the framed opening by suspension cables to prevent the door from trying to sag while in the open position.

Further objects and a better understanding of the invention can be had from the following description taken in conjunction with the drawings in which:

DETAILED DESCRIPTION OF THE PREFERRED EMBODIMENT

Figure 1:
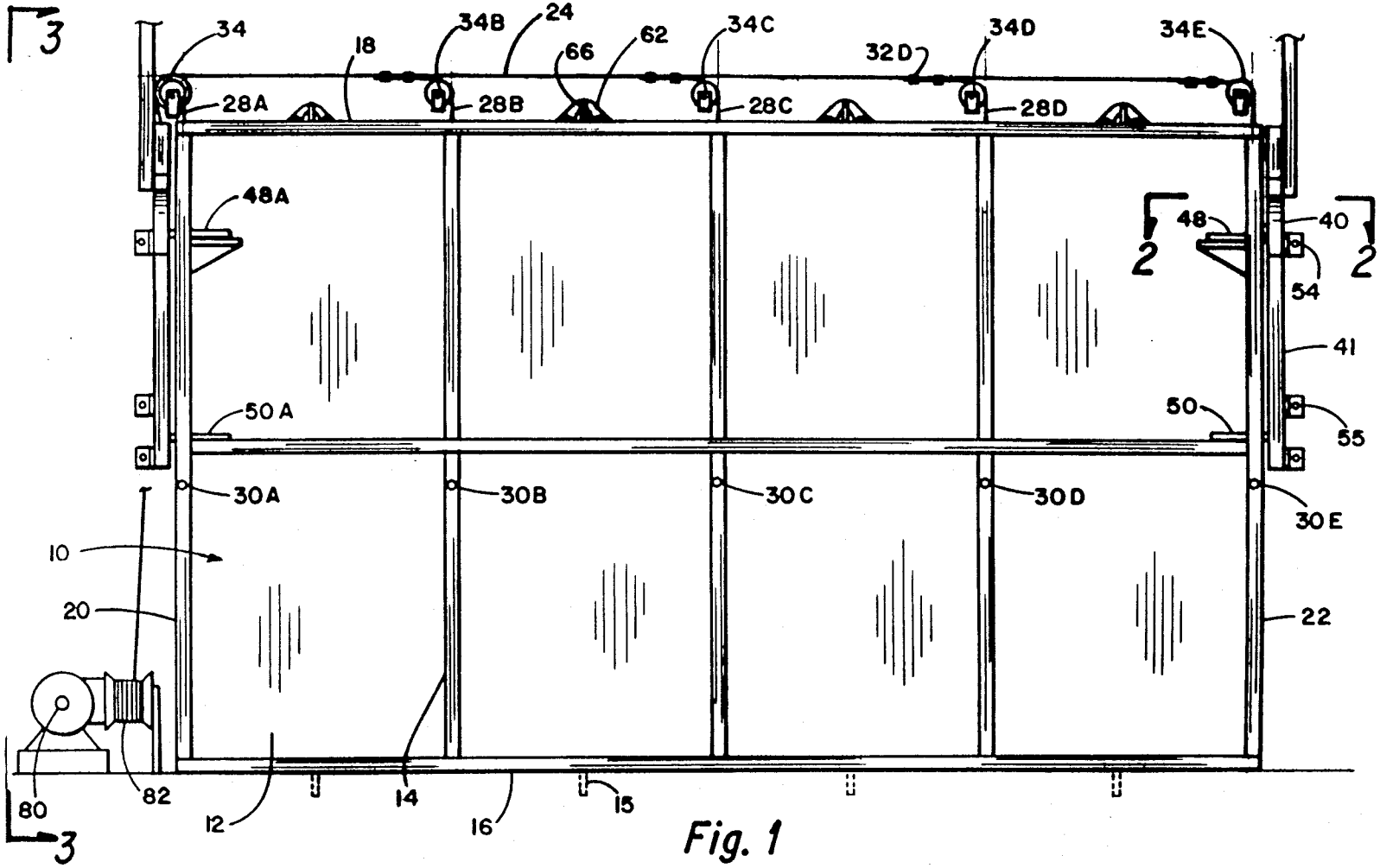
FIG. 1 is a full face view of a door in a closed position viewed from the inside of a building using a left-hand cable pull.

Attention is first directed to FIG. 1 which shows the tilt door assembly of my invention in a closed position and viewed from the inside of a building such as a garage, an airplane hangar, or the like. Shown thereon is a tilt door 10 which is a unitary door, that is, it is one solid unit. It includes framework 14, panels 12, top 18, bottom 16, ends 20 and 22, locking pins 15 at the bottom and stabilizing pins 66 at the top. The door assembly has a suspension system and a guide system.

Figure 5:
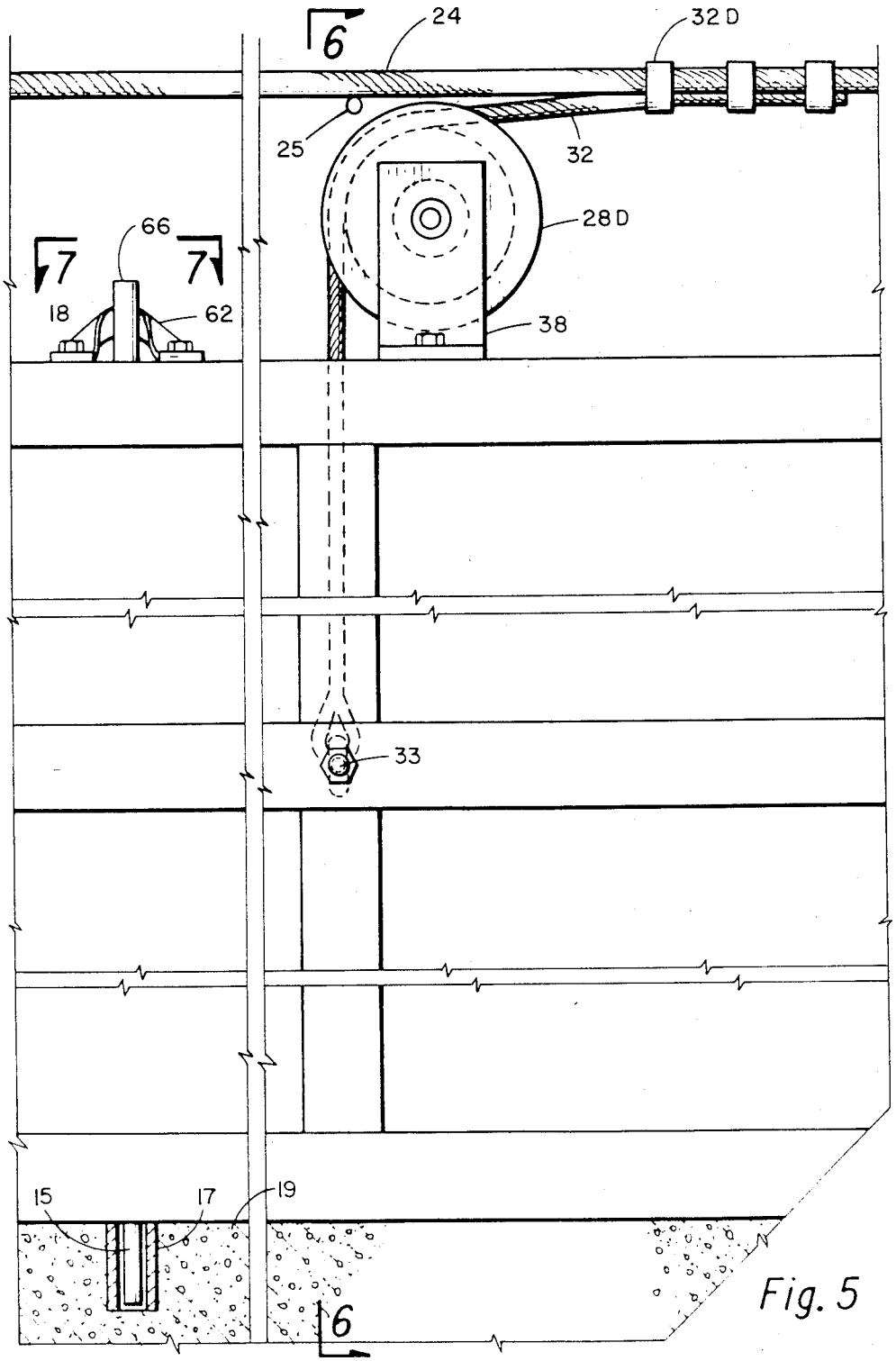
FIG. 5 is a view of section of the door showing the mounting of the suspension cables and top and bottom locking pins using right hand cable pull.
Figure 7:
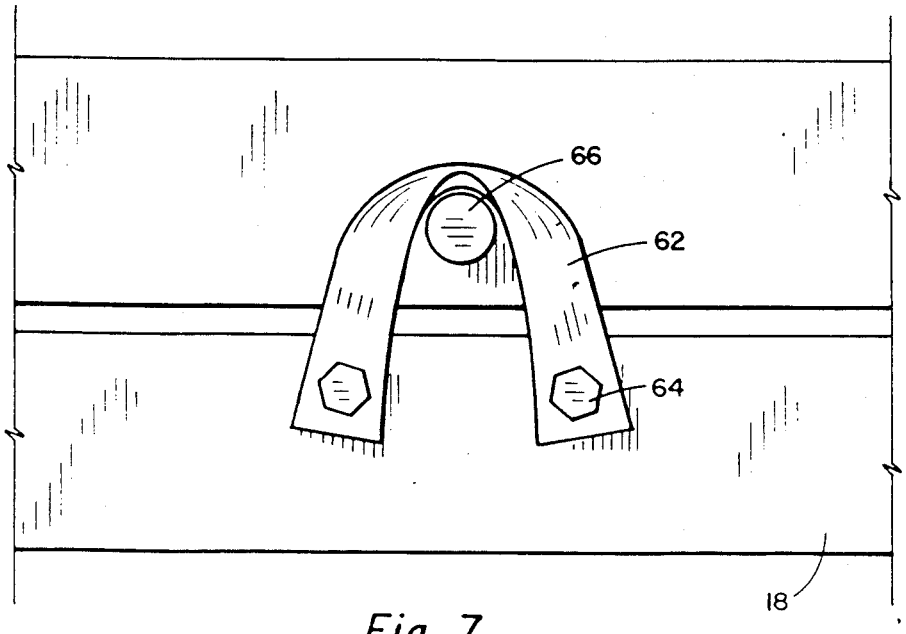
FIG. 7 is a view taken along the line 7—7 of FIG. 5.

The bottom of frame in FIG. 1 is provided with a plurality of locking pins 15 which is shown in FIG. 5 sits in hole 17 which is fixed to concrete 19. The upper end of the door is provided with a bracket 62 which is attached to the door 18 by bolt 64. The bracket 62 is looped over pin 66 which is attached to the frame as shown in FIG. 7. Locking pins 66 and latch 62 and lower locking pin 15 increases the door's stability which is especially important as the door gets larger and larger such as those used in airplane hangars. Thus will resist the force caused by winds blowing upon the large surface of the door when closed.

Figure 6:
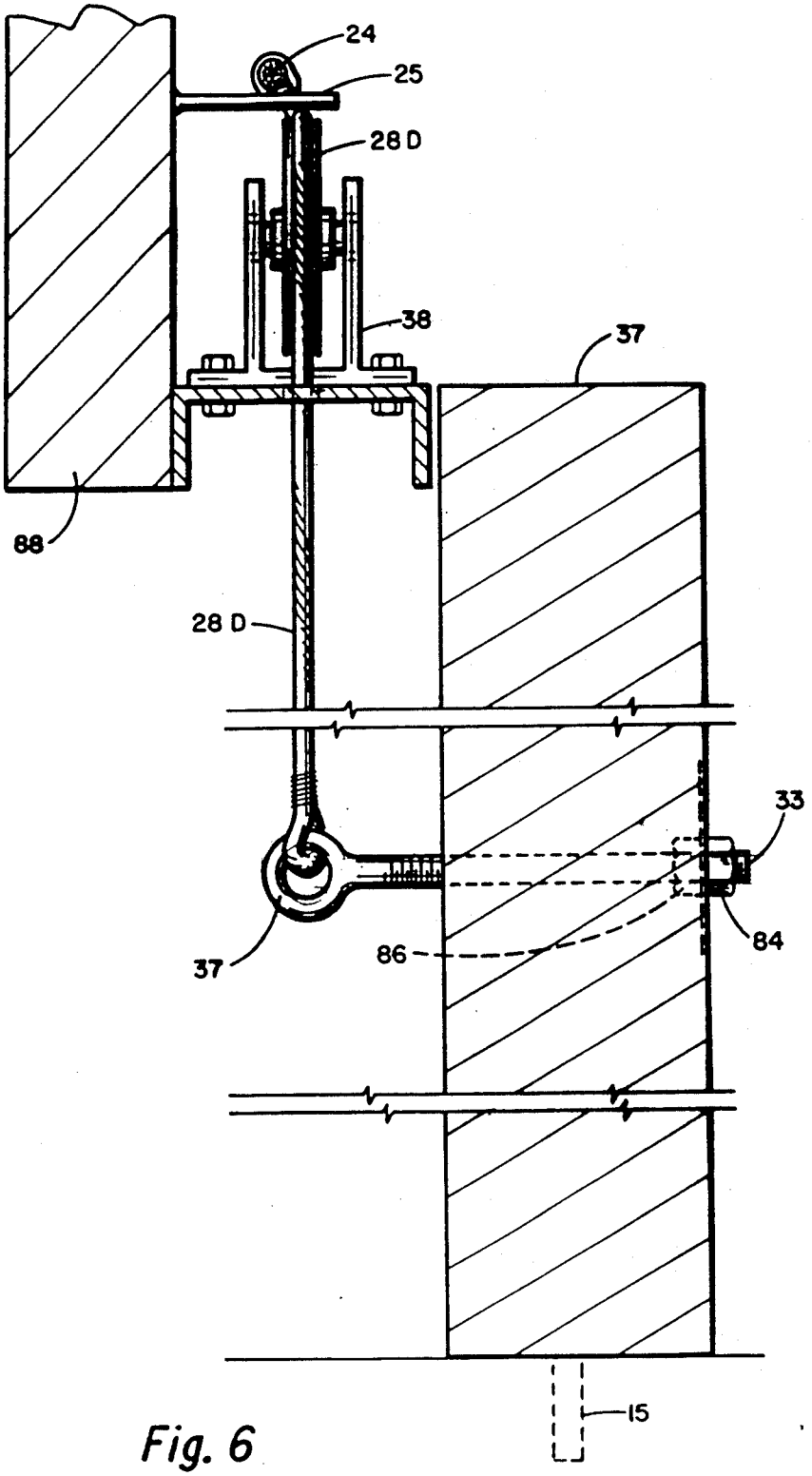
FIG. 6 is a view taken along the line 6—6 of FIG. 5.

The suspension system includes a power cable 24 connected across and above the top 18 of the door and extends in one end to near sheave 34E and other ends extends over double-grooved sheave 34 downwardly to a winch 82 driven by reversible motor 80. A plurality of suspension lines are connected to power cable 24. This includes suspension cable 28A to 28E. The suspension lines 28A to 28E extend over sheaves 34, 34B, 34C, 34D and 34E, respectively, and are connected to cable pins 30A to 30E, respectively on the outside of the door, with details more clearly shown in FIG. 6. As shown in FIG. 6 the bolt 33 is secured to the door by nuts 84 and 86. The outside of the bolt 33 is provided with an eye 37 to which the suspension line 28D is connected. The suspension line is supported by sheave 28D which in turn is supported by bracket 38 which suspends it from the frame 88 which is a part of the top of the frame 88 which can be a beam across the top of the doorway opening. A spacing pin 25 is attached to the beam 88 and extends under the power cable 24 and just above the suspension line 28. This helps support the cable 24 and prevents it from interfering with the operation of the sheave 34D and suspension lines 28D. This arrangement is provided for each suspension line.

Suspension line 28D is connected to power cable 24 in any conventional system, such as by brackets 32A as shown in FIG. 5.

Figure 2:
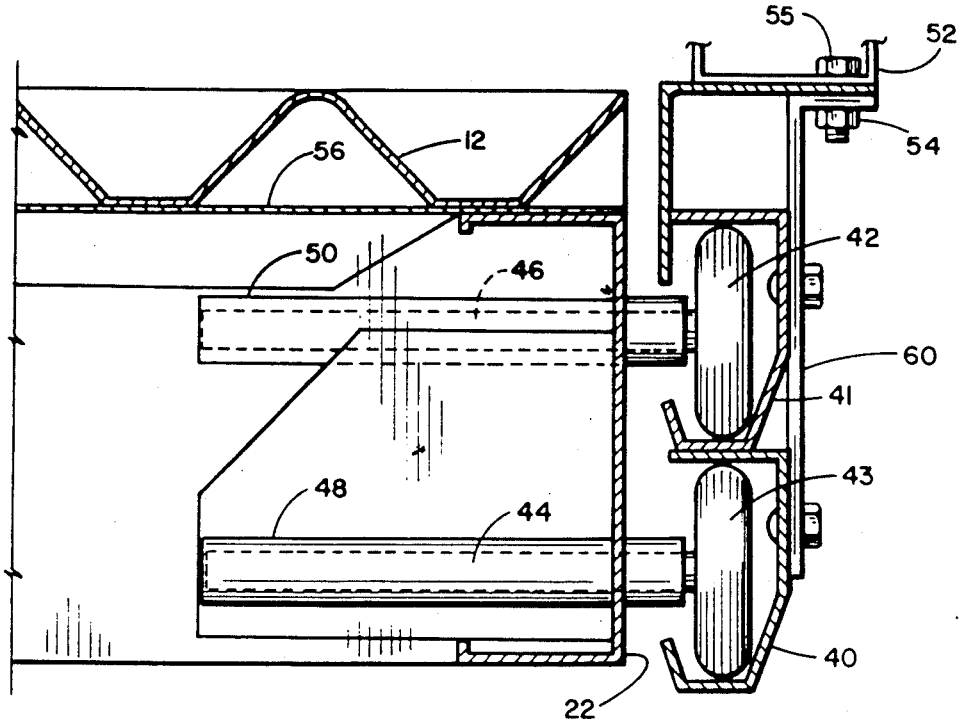
FIG. 2 is a view taken along the line 2—2 of FIG. 1.

While the door may be constructed of a variety of materials it is shown here as having corrugated panels 12 supported on frames 14, 16, 20 and 22. As shown in FIG. 2 the door may have insulation 56 between frame and the corrugated panels. The door is a one piece door and is relatively rigid and has no hinge sections. It may be called a door having a unitary construction.

Figure 3:
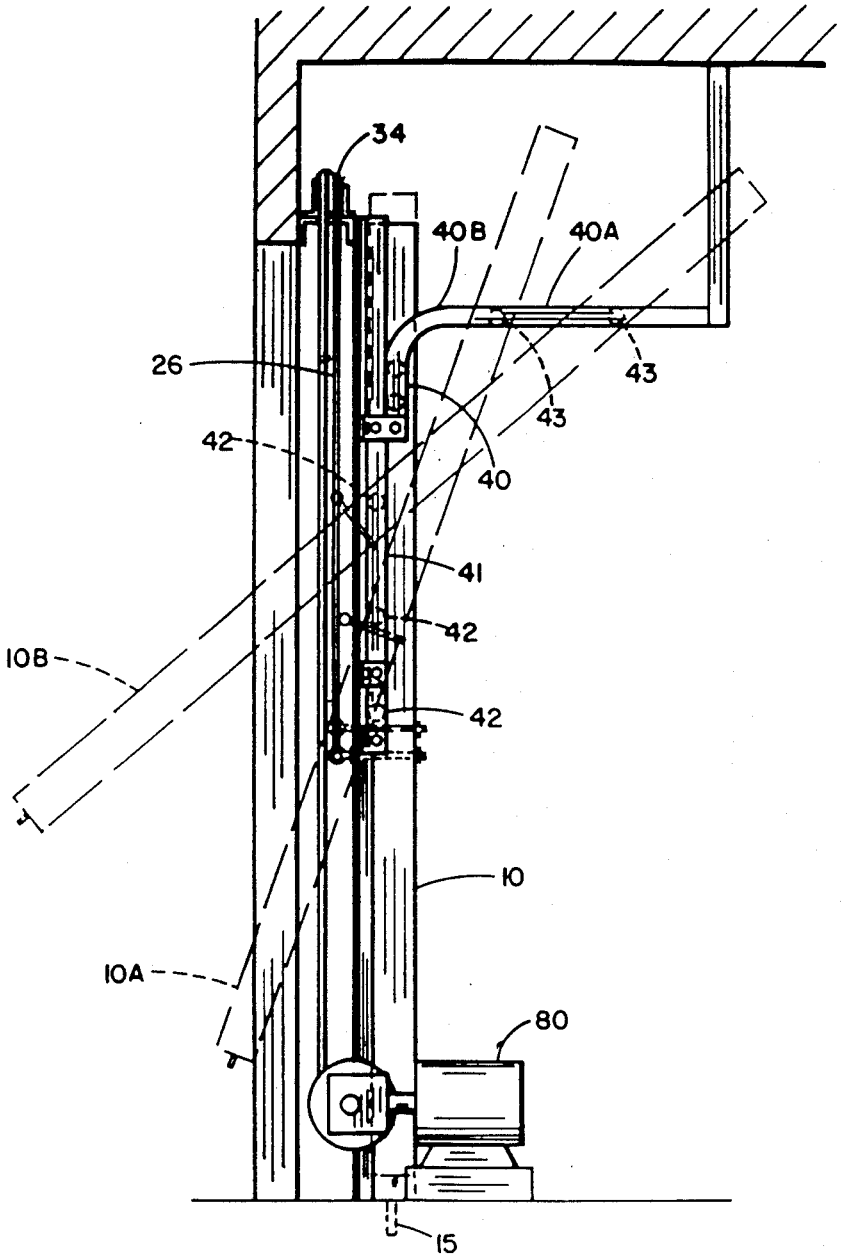
FIG. 3 is a side or end view of the door showing it in a closed position.

I shall now discuss the guide system. This overhead tilt door is provided with rollers and tracks which are used primarily as guides. Only four rollers are needed in this system. Two are mounted approximately half way up the door with one on each end thereof. Roller pin housings 50 and 50A are shown mounted to the door on each end. As shown in FIG. 2, a lower roller 42 having pin 46 is mounted in housing 50. A similar roller and pin is mounted in housing 50A. Lower rollers 42 are mounted in vertical roller guides 41. This vertical guide is attached to support 60 which is secured to door frame 52 in any well known manner such as by use of nuts and bolts 54 and 55. The vertical roller guide extends upwardly to the top of the open doorway. There are two other rollers 43 mounted one at each end of the door near the upper end. As shown in FIG. 2, upper roller 43 has pin 44 which connects into housing 48. A similar pin and roller is provided on the other end of the door in housing 48A. Upper roller 43 is mounted in an upper roller guide 40 which is also secured from support 60 similarly as was lower roller guide 41. The short vertical tracks 40 connect to a ninety degree section 40B which connects to a horizontal section 40A as shown in FIG. 3. It has been found that the radius for section 40B should normally be about nine inches. The straight vertical section 40 should be at least the length of locking pins 15 and stabilizing pins 66 so that they will clear the hole 17 and bracket 62, respectively before the door starts to tilt.

Figure 4:
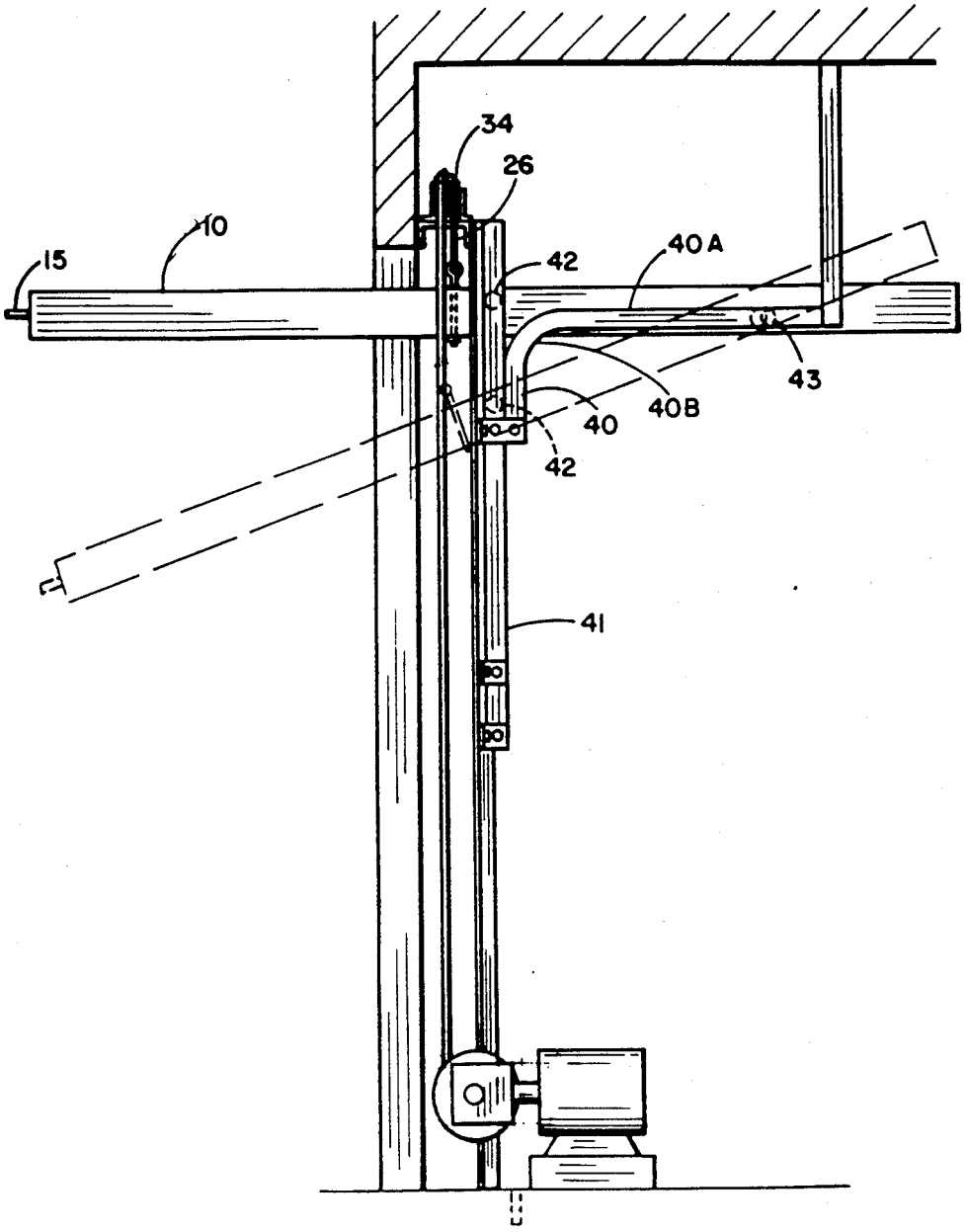
FIG. 4 is similar to FIG. 3 except it shows the door in an opened position.

Attention is next directed to FIGS. 3 and 4. FIG. 3 shows the closed position of the door and FIG. 4 shows the door in the open position in solid lines. Referring first to FIG. 3, when it is desired to open the door, motor 80 is energized and power cable 24 is wound about the winch 82. As it is wound about it, it pulls the suspension lines with it up over the top of sheaves 28A to 28D which starts the door to rise. As the door rises, the top rollers 43 move along the vertical section 40 of the top roller guide. The vertical section is sufficient length so that pin 15 will clear the floor before the roller 43 enters the curved portion 40B to start the door to tilt. Bracket 62 on top of the door has also cleared pin 66 during this movement so that the door is free to tilt with continued upward movement. The lower rollers 42 continue to roll up the vertical roller guide 41 and it is about lower rollers 42 that the door pivots as the upper rollers enter the curved section 40B and then the horizontal section 40A. Power cable 24 continues pulling so that the suspension cables pulls the door upwardly to its maximum height until roller 42 is in the position shown in FIG. 4. At this time the door 10 is in a horizontal or fully opening position with the top half of the door on the inside of the building and the lower half forming a porch or awning over the driveway. When it is desired to close the door the reverse procedure takes place. The motor is reversed and the door of its own weight starts to pivot about pivot point or roller 42 and as power cable 24 is released this continues through the various stages with the upper roller 43 going along the horizontal section 40A about the curved track section 40B and in to the vertical section 40. While roller 43 is moving through section 40B the door is pivoting about pivot roller 42. As the top roller enters vertical guide section 40 bracket 62 is looped over securing pin 66 and locking pin 15 proceeds to enter hole 17. This stabilizes the door in the closed position against wind forces.

The overhead tilt door is a very unique door. It is adaptable to almost any size framed opening from small garage doors to very large aircraft hangar doors. The door is a one piece framed unit of very simple construction which helps to reduce initial cost and keep maintenance to a minimum. My tilt door assembly also gives maximum utility of door width and minimal loss of door frame height while requiring very little headspace. It requires no rails, hinges, springs or counterweights. It used only about one-half the track of conventional overhead doors and about half the wire rope of conventional bi-fold doors.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims or claims, including the full range of equivalency to which each element thereof is entitled.

What is claimed:

1. An overhead tilt door assembly for use with a door opening having an inner side and an outer side in a building, said opening having a jamb on each side, a support beam along the top and a floor which comprises:

a unitary door having a top, a bottom, a first and a second end, an inner side and an outer side;

a first vertical track mounted along one of said jambs and a second vertical tract mounted along the other jamb, each extending from about the midsection of said jamb to the top thereof;

a third track and a fourth track each mounted in a jamb and each consisting of a short vertical section, a curved section connected to said vertical section and on its respective jamb a horizontal section at and perpendicular to the top of said door opening, said third and fourth tracks being closer to the inner side of said opening than said first and second tracks respectively;

a first roller and a second roller mounted on each end of said door, and extending into said first and second vertical track respectively;

third and fourth rollers mounted on said first and second end of said door respectively and mounted to engage said third and fourth tracks.

2. An overhead tilt door assembly as defined in claim 1 including a suspension system for said overhead tilt door which includes:

a plurality of sheaves supported by said suppport beam;

a winch having a power cable;

a plurality of essentially vertical suspension lines, each attached to said door below about its mid-point for each said sheave and extending upwardly vertically over said sheave and attached to said power cable whereby taking up on the power cable by said winch pulls the suspension cable up over said sheaves and raises the door.

3. An overhead tilt door assembly as defined in claim 2 including vertical locking pins attached to the bottom of said door.

4. An overhead tilt door assembly as defined in claim 3 including vertical locking pins extending upwardly and attached to said top of said door opening and a bracket forming a loop mounted on the top of said door and arranged to drop over and engage said top locking pins as said door is closed.

5. An overhead tilt door assembly as defined in claim 4 including a horizontal spacing pin adjacent each said sheave extending from and supported by the top of said door opening and positioned below said power cable and said suspension cable.

* * * * *